US006116854A

United States Patent [19]

Yuri

[11] Patent Number: 6,116,854

[45] Date of Patent: Sep. 12, 2000

[54] GAS TURBINE MOVING BLADE

[75] Inventor: Masanori Yuri, Hyogo-ken, Japan

[73] Assignee: Mitsubishi Heavy Industries, Ltd., Tokyo, Japan

[21] Appl. No.: 09/207,206

[22] Filed: Dec. 8, 1998

[30] Foreign Application Priority Data

Dec. 8, 1997 [JP] Japan ..... 9-337116

[51] Int. Cl.[7] ..... F01D 5/18

[52] U.S. Cl. ..... 416/97 R

[58] Field of Search ..... 416/97 R, 96 R, 416/97 A, 96 A

[56] References Cited

U.S. PATENT DOCUMENTS

| | | | |
|---|---|---|---|
| 4,278,400 | 7/1981 | Yamarik et al. | 416/97 R |
| 4,515,526 | 5/1985 | Levengood . | |
| 4,775,296 | 10/1988 | Schwarzmann et al. . | |
| 5,395,212 | 3/1995 | Anzai et al. | 416/97 R |
| 5,403,159 | 4/1995 | Green et al. | 416/97 R |
| 5,488,825 | 2/1996 | Davis et al. . | |
| 5,857,837 | 1/1999 | Zelesky et al. | 416/97 R |

FOREIGN PATENT DOCUMENTS

| | | |
|---|---|---|
| 59-122705 | 7/1984 | Japan . |
| 8-170501 | 7/1996 | Japan . |
| WO96/12874 | 5/1996 | WIPO . |

*Primary Examiner*—Edward K. Look
*Assistant Examiner*—Ninh Nguyen
*Attorney, Agent, or Firm*—Sughrue, Mion, Zinn, Macpeak & Seas, PLLC

[57] ABSTRACT

A gas turbine moving blade assembly in which a cooling effect at a leading edge of the blade, which is exposed to a high temperature combustion gas, is enhanced by an arrangement of turbulators in the leading edge. In particular, the turbulators are arranged on a slant and are arranged locally only on portions in which the cooling effect is to be reinforced, so that pressure loss of the cooling air is suppressed to a minimum level. Turbulators (8) are provided obliquely from the leading edge in a direction facing into a flow of the cooling air toward a downstream side of a combustion gas flow on both inner walls within a cooling passage (12). Also, to reduce pressure loss, short turbulators (18) may be similarly arranged between the adjacent turbulators (8). In this case, the ratio of the length (W) of the turbulators to that (Wr) of the short turbulators is Wr/W<0.5. Secondary flows (20*a*, 20*a*') are generated along the turbulators (8, 18) to effectively cool joint portions between the leading edge and the turbulators.

7 Claims, 4 Drawing Sheets

GAS TURBINE MOVING BLADE

BACKGROUND OF THE INVENTION

1. Field of the Invention

The present invention relates to a gas turbine moving blade provided with a turbulator, and more particularly to an arrangement of a turbulator of a leading edge cooling passage within a gas turbine moving blade.

2. Description of the Related Art

FIG. 4 is a cross-sectional view showing a normal conventional moving blade. In FIG. 4, a moving blade having a leading edge 17 and a trailing edge 16 as a whole is generally designated by reference numeral 11. A cooling passage 17 is provided inside of the leading edge 12. Reference numerals 13, 14 and 15 denote cooling passages which are in communication with each other to form a serpentine cooling passage. Cooling air 20 passes through a cooling passage 12 on the leading edge 17 side and cools the leading edge portion to flow out of a tip end portion of the moving blade 11. Cooling air 21 is introduced into the cooling passage 13 to flow toward a tip end portion 21*a* where the cooling air flows to the next cooling passage 14. Then, the cooling air 21 flows toward a proximal end portion of the cooling passage 14 and flows toward the cooling passage 15 on the side of the trailing edge 16 through a proximal end portion 21*b* to be discharged from a combustion gas passage 21*c* through a number of air holes provided in the trailing edge 16.

FIG. 5 is an enlarged cross-sectional view taken along the line C—C of FIG. 4. A number of turbulators 28 are provided in a multi-stage manner from top to bottom of both wall surfaces within the cooling passage 12 on the side of the leading edge 17. The turbulators 28 are provided to make the stream of the introduced cooling air 20 turbulent to enhance heat transmission.

FIG. 6 is an enlarged longitudinal sectional view of a part of the cooling passage 12 on the side of the leading edge 17. A rib 31 is provided in the interior on the side of the leading edge 17 of the moving blade 11 whereby the cooling passage 13 and the cooling passage 12 are partitioned from each other to define the cooling passage 12. The plurality of turbulators 28 which are slanted upwardly in the direction of combustion gas flow G over the upper and lower portions of both wall surfaces of this cooling passage 12, i.e., which are slanted in the direction of gas flow the cooling air 20 toward the downstream side of the direction of combustion gas flow G are arranged on both wall surfaces of the cooling passage 12. The cooling air 20 is introduced from the proximal end portion of the moving blade 11 to flow toward the tip end thereof to cool the interior of the leading edge 17 from the inside. However, the cooling air that flows upwardly along both wall surfaces of the cooling passage 12 is caused to impinge against the turbulators 28. By this impingement, as shown in the drawing, secondary flows 20*b* along the slant of the turbulators 28 toward the rib 31 are generated at each turbulator 28. As a result, high heat transmission efficiency is obtained at the rib 31 (portion D indicated by the broken line) at a border between each turbulator 28 and the adjacent cooling passage 13 with which each turbulator 28 continue.

However, it is impossible to obtain this cooling effect at the portion D on the rib 31 side at the side of the leading edge 17 (portion E indicated by the broken line) with which each turbulator 28 is continuous. The heat transmission on the leading edge side which is most frequently exposed to the high temperature combustion gas is lowered. Although the turbulators 28 are attached to the cooling passage 12 so that the heat transmission efficiency may be enhanced as a whole, as shown in FIG. 6 and as described above, it is impossible to obtain a satisfactory effect for cooling the leading edge 17 which most needs the cooling effect, i.e., for cooling the portion E. Accordingly, it is desired to enhance the heat transmission efficiency in this portion.

Also, if the turbulators are provided, the heat transmission efficiency is enhanced but on the other hand, the pressure loss of the cooling air is increased. Accordingly, it is necessary to improve the mutually inconsistent phenomenon of enhancement of the heat transmission and the loss of the pressure. In view of these two factors, it is necessary to optimize the arrangement of the turbulators.

SUMMARY OF THE INVENTION

Accordingly, an object of the present invention is to provide a gas turbine moving blade assembly in which a cooling effect at a leading edge exposed to a high temperature combustion gas is enhanced in view of an arrangement of turbulators of the leading edge of the gas turbine moving blade assembly, and particularly of a slant of the turbulators, at the same time, the turbulators are arranged locally only on a portion in which the cooling effect is to be reinforced, and a pressure loss of the cooling air is suppressed to a minimum level.

In view of the above and other objects which will become apparent as the description proceeds, there is provided according to a general aspect of the present invention a gas turbine moving blade assembly comprising a leading edge confronting a combustion gas flow and a trailing edge, a cooling passage defined in an interior of the leading edge for causing cooling air to flow from a proximal end portion of a vane to a tip end of the vane, and a plurality of turbulators arranged in a direction transverse to a flow of the cooling air and slanted relative to the combustion gas flow on both facing inner wall surfaces of the cooling passage, wherein the turbulators are arranged to be slanted from the leading edge in a direction into the flow of the cooling air toward a downstream side of the combustion gas flow.

Since the turbulators are slanted from the leading edge in the direction facing the flow of the cooling air toward the downstream side of the combustion gas flow, the cooling air that enters from the proximal end portion of the moving blade and flows through the central portion of the cooling passage is moved toward the tip end portion while being made turbulent by the turbulators, thereby cooling the leading edge. Also, at both inner wall surfaces of the leading edge of the moving blade, the cooling air is impinged against the turbulators to generate the secondary flows flowing toward the leading edge along the slant of the turbulators, whereby the heat transmission efficiency of the inner wall portion at the tip end of the leading edge—which is mostly exposed to the combustion gas kept at a high temperature and is in thermally severe circumstances—is enhanced. The cooling effect is enhanced at this portion.

In a preferred mode for carrying out the invention, the plurality of slanted turbulators are composed, in combination, of long turbulators arranged at length in a transverse direction of the cooling passage from the leading edge of the cooling passage and short turbulators from the leading edge of the cooling passage to a midpoint.

Since the turbulators are composed of the long turbulators and the short turbulators arranged in combination, the cooling effect at the leading edge which needs to be cooled in particular is enhanced by the secondary flows of the short turbulators, and at the same time, the pressure loss of the cooling air may be reduced.

In another preferred mode for carrying out the invention, the ratio of a length (Wr) of the short turbulators to a length (W) of the long turbulators meets a relationship, Wr/W<0.5.

Since the ratio of the length of the short turbulators to the length of the long turbulators is less than 0.5, the rate of blocking of the cooling air flow by the short turbulators is suppressed to positively reduce the pressure loss.

The above and other objects, features and attendant advantages of the present invention will be more easily understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DETAILED DESCRIPTION OF THE PREFERRED EMBODIMENTS

Figure 1A:
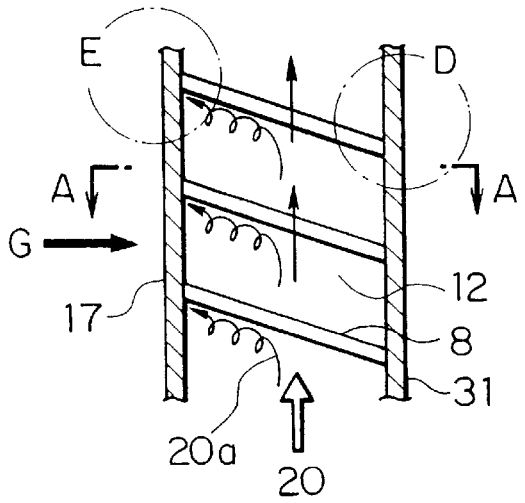
FIGS. 1(*a*) and 1(*b*) show turbulators for a gas turbine moving blade in accordance with a first embodiment of the present invention, FIG. 1(*a*) is a longitudinal sectional view thereof and FIG. 1(*b*) is a sectional view taken along the line A—A of FIG. 1(*a*)

The present invention will be described in detail in conjunction with what is presently considered as preferred or typical embodiments thereof by reference to the drawings.

In the following description, like reference characters designate like or corresponding parts throughout the several views. Also in the following description, it is to be understood that such term as "left", "right", "top", "bottom" and the like are words of convenience and are not to be construed as limiting terms.

Embodiment 1

Figure 1B:
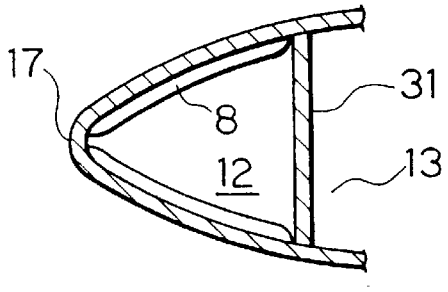

FIGS. 1(*a*) and 1(*b*) show turbulators for a gas turbine moving blade in accordance with a first embodiment of the present invention. FIG. 1(*a*) is a longitudinal sectional view thereof and FIG. 1(*b*) is a sectional view taken along line A—A of FIG. 1A. In these drawings, a cooling passage 12 on the side of a leading edge 17 and an adjacent cooling passage 13 are partitioned and formed by a rib 31 inside of the leading edge 17 of a blade. A plurality of turbulators 8 are provided from top to bottom of both wall surfaces of the cooling passage 12 in a multi-stage manner. The plurality of turbulators 8 are arranged so as to be slanted downwardly toward the cooling passage 17 side from the leading edge 13 side relative to a combustion gas flow direction G, i.e. so as to be slanted from the leading edge in a direction facing into the flow of a cooling air 20 toward the downstream of the combustion gas flow direction G. This downward slant is opposite to the slant of the conventional turbulators 28 (see FIG. 6).

The cooling air 20 is introduced from the proximal end portion side of the moving blade into the cooling passage 12 on the side of the leading edge 17 having the above-described turbulators 8. The cooling air 20 is caused to flow toward the tip portion to cool the leading edge 17 from interior while the flow thereof is being made turbulent. On the other hand, the cooling air that flows along both wall portions collides with the turbulators 8. Since the slant of the turbulators is directed toward the downstream of the combustion gas flow direction G in a direction facing into the flow of the cooling air 20, i.e., toward the downstream of the flow approaching the leading edge 17 side as viewed from the side of the cooling air 20, a secondary flow 20*a* that is directed to the leading edge 17 along the turbulators is generated.

Figure 6:
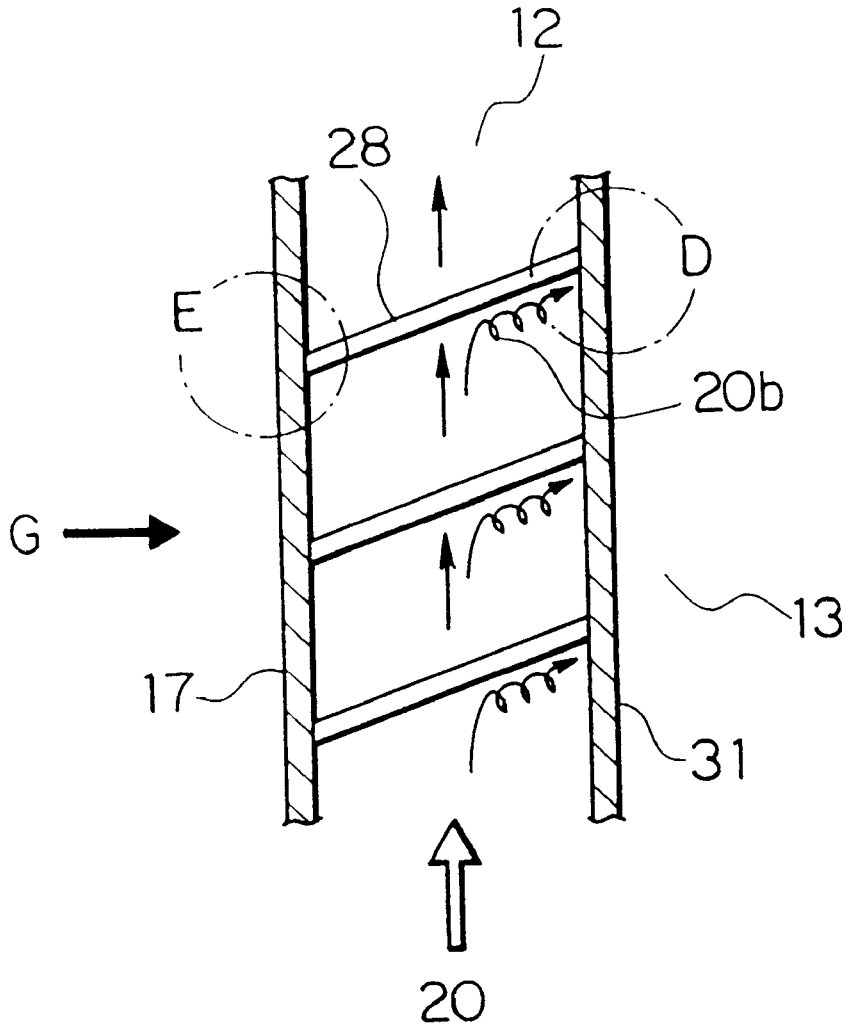
FIG. 6 PRIOR ART
FIG. 6 is a longitudinal sectional view of a leading edge of a conventional gas turbine moving blade.

The secondary flow 20*a* flows in a direction opposite to the conventional secondary flow 20*b* as shown in FIG. 6 due to the slant of the turbulators. Accordingly, the secondary flow 20*a* is directed to the leading edge 17 that has the greatest exposure to the high temperature combustion gas. Accordingly, by the secondary flow 20*a*, the heat transmission efficiency of the joint portion (portion E indicated by the broken line) between the turbulator 8 and the leading edge 17 is enhanced to accelerate the cooling effect at this portion. In the conventional system, the cooling effect of the joint portion (portion D indicated by the broken line) between the turbulator 8 and the rib 31 is enhanced. However, according to the first embodiment, the cooling effect of the joint portion (portion E) on the leading edge side is enhanced.

Embodiment 2

Figure 2A:
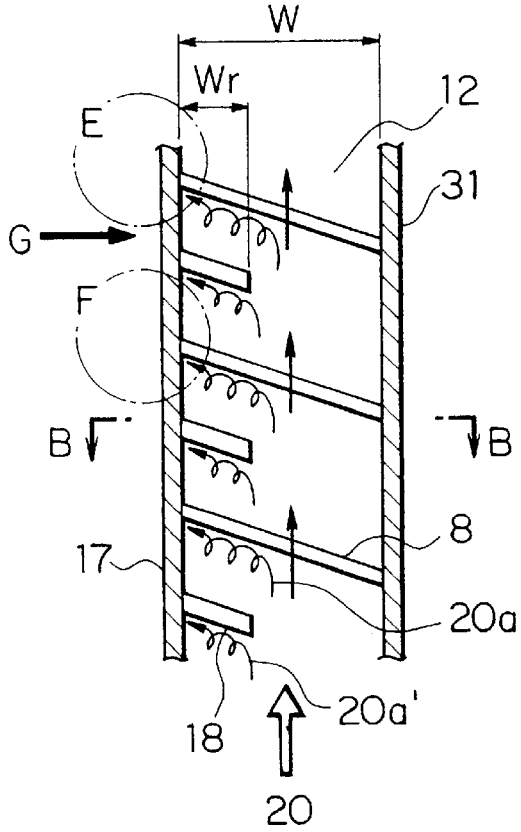
FIGS. 2(*a*) and 2(*b*) show turbulators for a gas turbine moving blade in accordance with a second embodiment of the present invention, FIG. 2(*a*) is a longitudinal sectional view thereof and FIG. 2(*b*) is a sectional view taken along the line B—B of FIG. 2(*a*)
Figure 2B:
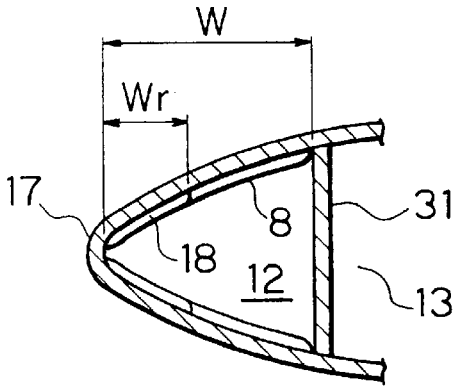

FIGS. 2(*a*) and 2(*b*) show turbulators for a gas turbine moving blade in accordance with a second embodiment of the present invention. FIG. 2(*a*) is a longitudinal sectional view thereof and FIG. 2(*b*) is a sectional view taken along the line B—B of FIG. 2(*a*). In these drawings, the difference from the first embodiment is that turbulators 8 and short turbulators 18 are arranged alternately and the rest is the same as in the embodiment shown in FIGS. 1(*a*) and 1(*b*).

In FIGS. 2(*a*) and 2(*b*), the turbulators 18 are arranged alternately in a direction transverse of the upward flow of the cooling air 20 and are slanted downwardly from the leading edge to the midpoint. The ratio of the length W of the turbulators 8 from the inner wall of the leading edge 17 to a rib 31 to the length Wr of the short turbulators 18 from the inner wall of the leading edge 17 to the midpoint meets the relationship, Wr/W<0.5. With such an arrangement, the cooling efficiency at the cooling passage 12 on the side of the leading edge 17 as a whole is degraded in comparison with the first embodiment in which all the turbulators within the cooling passage are arranged to transverse the cooling passage. However, the secondary flow 20*a* is generated in the joint portion (portion E) between the leading edge 17 and the turbulator 8, and a secondary flow 20*a* is generated in the joint portion (portion F) between the leading edge 17 and the short turbulator 18. By the secondary flows, the cooling effect at each joint portion (portion E and portion F) is enhanced, and at the same time, the pressure loss of the cooling air may be reduced by the short turbulators 18.

Embodiment 3

Figure 3:
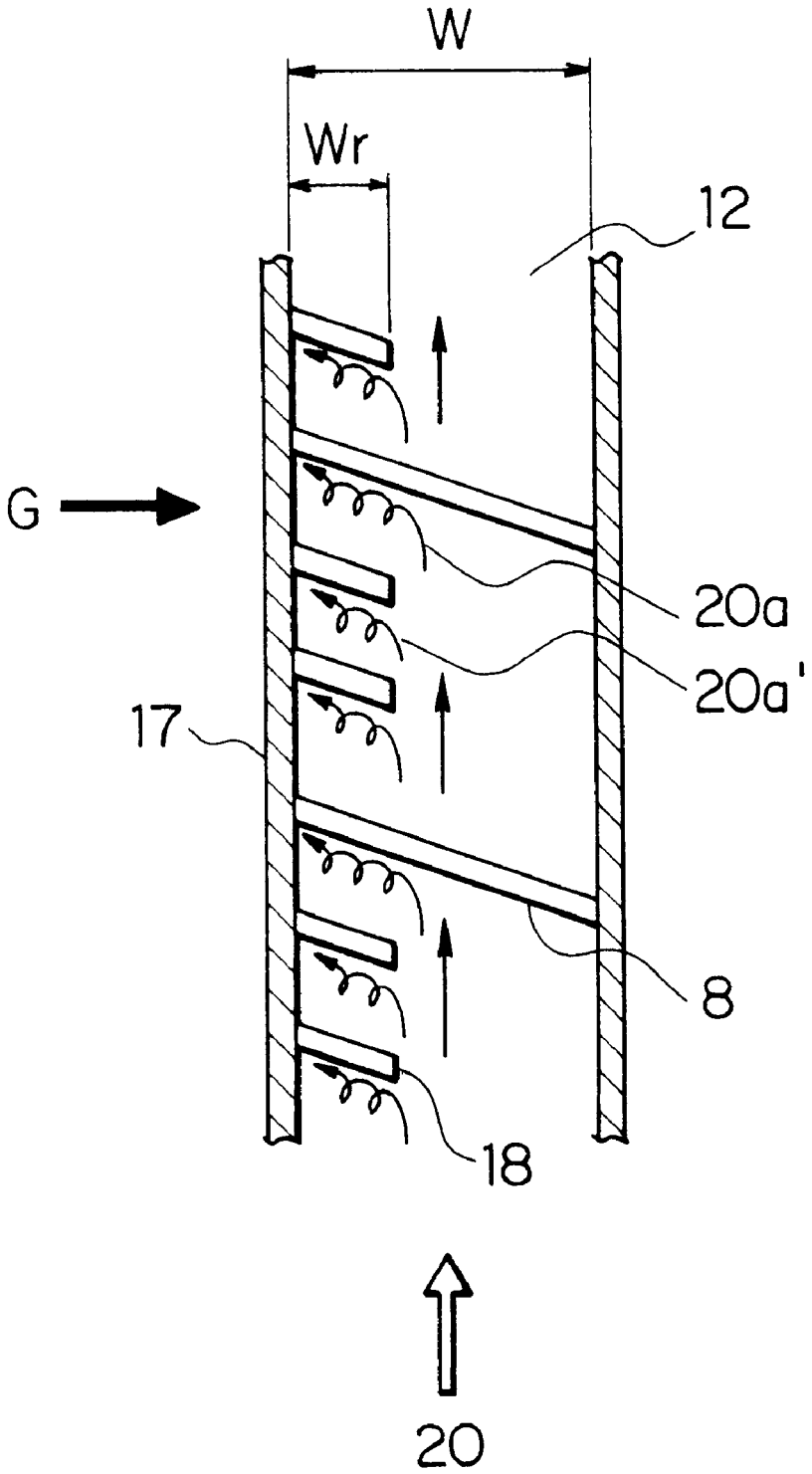
FIG. 3 is a longitudinal sectional view showing turbulators of a gas turbine moving blade in accordance with a third embodiment of the present invention.
Figure 4:
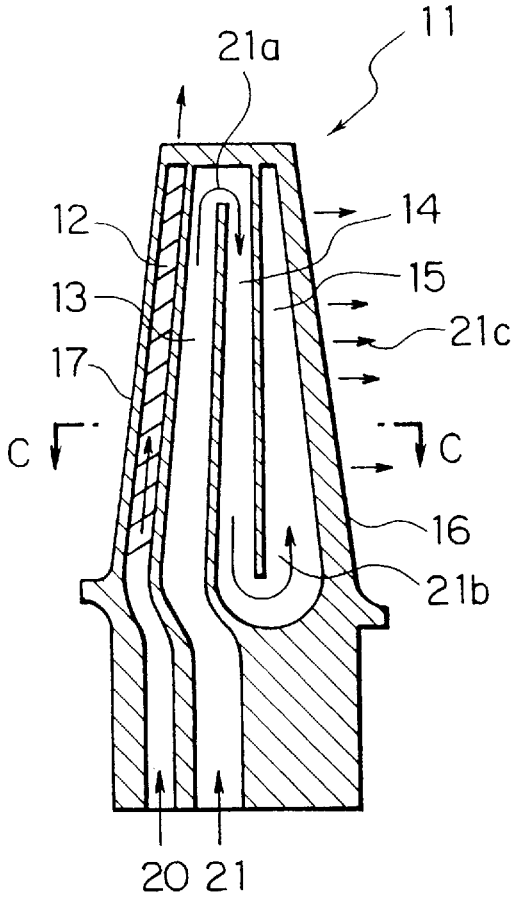
FIG. 4 PRIOR ART
FIG. 4 is a longitudinal-sectional view showing a conventional general gas turbine moving blade.
Figure 5:
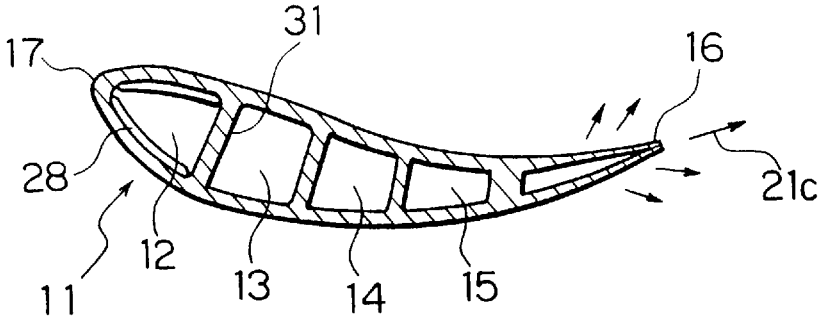
FIG. 5 PRIOR ART
FIG. 5 is an enlarged cross-sectional view taken along the line C—C of FIG. 4.

FIG. 3 is a longitudinal sectional view showing turbulators of a gas turbine moving blade in accordance with a third embodiment of the present invention. In FIG. 3, the difference from the second embodiment is that two short turbulators 18 are arranged between each long turbulator 8 and the other points are the same as in the second embodiment shown in FIG. 2. With such an arrangement, the same effect as that of the second embodiment is ensured and at the same time pressure loss of the cooling air may be further reduced in comparison with the second embodiment.

In the foregoing third embodiment, the explanation has been given as to an example in which two rows of short turbulators 18 are arranged in a continuous manner. However, the arrangement of the short turbulators 18 is not limited to this example. It is possible to use any number or any arrangement in combination as desired. The short turbulators 18 are mounted to portions where the cooling effect should be particularly reinforced, and no short turbulators 18 need be provided to the other portions. In this case, pressure loss may be reduced even more in the same manner.

With the turbulators for gas turbine moving blades in accordance with the first, second and third embodiments as described above, the turbulators 8 are arranged to be slanted downwardly in the direction of combustion gas flow whereby the cooling effect at the leading edge 17 most exposed to the high temperature combustion gas may be enhanced. The downwardly slanted turbulators 8 and the short turbulators 18 may also be used in combination whereby the cooling effect at the leading edge 17 is enhanced and at the same time, the pressure loss of the cooling air may be reduced.

Depending upon the scale of the gas turbine, it is possible to use the turbulators according to the first embodiment or to use the turbulators of the second embodiment or the third embodiment.

Various details of the invention may be changed without departing from its spirit or its scope. Furthermore, the foregoing description of the embodiments according to the present invention are provided for the purpose of illustration only, and not for the purpose of limiting the invention as defined by the appended claims and their equivalents.

What is claimed is:

1. A gas turbine moving blade assembly comprising:

a leading edge confronting a combustion gas flow and a trailing edge;

a cooling passage defined in an interior of said leading edge for causing cooling air to flow from a proximal end portion of the blade to a tip end of the blade; and, a plurality of turbulators arranged in a direction transverse to a flow of the cooling air and slanted relative to the combustion gas flow, wherein said plurality of turbulators includes long turbulators and short turbulators, both said long turbulators and said short turbulators being provided on facing inner wall surfaces of the cooling passage, wherein said long turbulators and said short turbulators are slanted from the leading edge, in a direction into the flow of the cooling air, toward a downstream side of the combustion gas flow.

2. The gas turbine moving blade assembly according to claim 1, wherein said long turbulators extend from said leading edge of said cooling passage across a whole length of the cooling passage, wherein said length of the cooling passage is measured in a direction transverse to that of the cooling flow, and said short turbulators extend along the length of the cooling passage from the leading edge of said cooling passage to a midpoint in the cooing passage.

3. The gas turbine moving blade assembly according to claim 2, wherein a ratio of a length (Wr) of said short turbulators to a length (W) of said long turbulators meets a relationship, $Wr/W<0.5$.

4. The gas turbine moving blade assembly according to claim 1, wherein said long turbulators and said short turbulators are disposed in an alternate arrangement.

5. The gas turbine moving blade assembly according to claim 1, wherein two short turbulators are disposed between each adjacent pair of long turbulators.

6. The gas turbine moving blade assembly according to claim 1, wherein at least one of said long turbulators has a uniform width across its entire length.

7. The gas turbine moving blade assembly according to claim 1, wherein at least one of said short turbulators has a uniform width across its entire length.

* * * * *